US007467761B2

(12) United States Patent
Yehezkeli et al.

(10) Patent No.: US 7,467,761 B2
(45) Date of Patent: Dec. 23, 2008

(54) METHOD AND SYSTEM FOR ADJUSTING THE FLIGHT PATH OF AN UNGUIDED PROJECTILE, WITH COMPENSATION FOR JITTERING DEVIATION

(75) Inventors: Oded Yehezkeli, Tivon (IL); Irad Kunreich, Haifa (IL)

(73) Assignee: Rafael-Armament Development Authority Ltd, Haifa (IL)

( * ) Notice: Subject to any disclaimer, the term of this patent is extended or adjusted under 35 U.S.C. 154(b) by 308 days.

(21) Appl. No.: 11/128,654

(22) Filed: May 13, 2005

(65) Prior Publication Data

US 2006/0060692 A1 Mar. 23, 2006

(30) Foreign Application Priority Data

May 17, 2004 (IL) ..... 162027

(51) Int. Cl.

| | |
|---|---|
| ***F41G 7/00*** | (2006.01) |
| ***F41F 3/04*** | (2006.01) |
| ***F42B 15/01*** | (2006.01) |
| *F42B 12/00* | (2006.01) |
| *F42B 15/00* | (2006.01) |
| *F42B 30/00* | (2006.01) |

(52) U.S. Cl. ..... 244/3.11; 244/3.1; 244/3.14; 102/501; 89/1.8; 89/1.813; 89/1.815; 89/1.816; 89/1.11

(58) Field of Classification Search ..... 244/3.1–3.3; 89/1.8–1.819, 14.05, 14.3, 1.11; 102/501–529
See application file for complete search history.

(56) References Cited

U.S. PATENT DOCUMENTS 1,108,717 A 8/1914 Davis (Continued)

FOREIGN PATENT DOCUMENTS

GB 2140538 11/1984

(Continued)

OTHER PUBLICATIONS

"Raytheon Electronic Systems FIM-92 Stinger low-altitude surface-to-air missile system family"; Jane's Land-Based Air Defence; Oct. 13, 2000; no author listed; on the Internet at www.janes.com.*

(Continued)

*Primary Examiner*—Bernarr E Gregory
(74) *Attorney, Agent, or Firm*—Ohlandt, Greeley, Ruggiero & Perle, L.L.P.

(57) ABSTRACT

A method for adjusting the flight path of an unguided projectile, which comprises the steps of: (a) Measuring the magnitude and direction of the jittering of a projectile launch tube, at an ejection time of a projectile from the launch tube; (b) Measuring a velocity deviation of the projectile from a nominal velocity; (c) Measuring an angular deviation of the sight of the launch tube, being equal to the angular deviation between a line coinciding with the direction of gravity and a line passing through the center of the launch tube and the center of the sight; (d) Determining a compensating impulse vector to be applied to the projectile during an initial flight path thereof based on the magnitude and direction of the jittering, velocity deviation and angular deviation; and (e) Applying the compensating impulse vector to the projectile by activating a flight correction unit, the thrust developed by the flight correction unit suitable for adjusting the flight path of the projectile by a magnitude and direction substantially equal to that of the compensating impulse vector.

14 Claims, 9 Drawing Sheets

U.S. PATENT DOCUMENTS

| | | | | | |
|---|---|---|---|---|---|
| 2,822,755 | A | * | 2/1958 | Edwards et al. | 244/3.22 |
| 3,749,334 | A | * | 7/1973 | McCorkle, Jr. | 244/3.22 |
| 3,807,274 | A | | 4/1974 | Cohen | 89/1.81 |
| 4,023,749 | A | * | 5/1977 | McCorkle, Jr. | 244/3.22 |
| 4,370,716 | A | * | 1/1983 | Amieux | 244/3.22 |
| 4,645,139 | A | * | 2/1987 | Guillot et al. | 244/3.22 |
| 4,762,293 | A | * | 8/1988 | Waddington | 244/3.22 |
| 4,899,956 | A | * | 2/1990 | King et al. | 244/3.21 |
| 5,123,612 | A | * | 6/1992 | Labroche et al. | 244/3.22 |
| 5,423,242 | A | | 6/1995 | Schuemann | 89/14.3 |
| 5,467,940 | A | * | 11/1995 | Steuer | 244/3.11 |
| 5,875,993 | A | * | 3/1999 | Weiss et al. | 244/3.22 |
| 5,880,396 | A | * | 3/1999 | Zacharias | 244/3.22 |
| 6,138,945 | A | * | 10/2000 | Biggers et al. | 244/3.22 |
| 6,347,763 | B1 | * | 2/2002 | Harkins et al. | 244/3.21 |
| 7,102,113 | B2 | * | 9/2006 | Fujita et al. | 244/3.21 |

FOREIGN PATENT DOCUMENTS

| | | | |
|---|---|---|---|
| GB | 2140538 | A | 11/1984 |

OTHER PUBLICATIONS

J. Lyons et al, "Critical Technology Events in the Development of the Stinger and Javelin Missile Systems: Project Hindsight Revisted"; Center for Technology and National Security Policy; National Defence University; Jul. 2006.*

International Search Report, dated Jul. 9, 2005, 3 pages.

European Search Report dated Aug. 29, 2005.

* cited by examiner $$I_y = I_{y1} + I_{y2} + I_{y3} \qquad I_z = I_{z1} + I_{z2} + I_{z3}$$

METHOD AND SYSTEM FOR ADJUSTING THE FLIGHT PATH OF AN UNGUIDED PROJECTILE, WITH COMPENSATION FOR JITTERING DEVIATION

FIELD OF THE INVENTION

The present invention relates to a method and system for adjusting the flight path of an unguided projectile, immediately after launching, in order to compensate for inaccuracies that result from barrel jittering during the projectile firing.

BACKGROUND OF THE INVENTION

Three types of short range missiles, i.e. with a range generally of less than 1 km, are known:

Missiles with homing guidance that can be locked on a desired target (very accurate);

Beam-riding missiles (less accurate than those with homing guidance); and

Inertially guided missiles (less accurate than beam-riding missiles).

In contrast, projectiles launched in a ballistic trajectory by means of a thrust producing device, such as a bazooka, without guidance control during the flight after launching are relatively inaccurate, and therefore generally have an effective range of up to 300 m.

Several methods have been employed in the prior art in order to improve the accuracy attainable with unguided projectiles:

Reducing the jittering of the projectile launcher by concurrently firing a compensating mass rearwardly from the launch tube as the projectile is fired forwardly therefrom. Launchers which apply such a method are generally referred to as Davis guns.

Using a laser rangefinder for accurately measuring the distance to the selected target, and using the measured distance in order to adjust the angle of the launch tube through which the projectile is fired;

Reducing the drift of the projectile by providing the projectile with a cruising motor which generates a thrust equal to the nominal drag.

It has been found that a major source of unguided projectile inaccuracy is the jittering of the associated launch tube that is produced at the time of launching. More particularly, launch tube jittering causes the actual launching direction to deviate from the launching direction—hereinafter referred to as a "nominal direction,"—which is generally established by aiming the launch tube in a desired direction. The method proposed by the Davis Gun, as described in U.S. Pat. No. 1,108,717, although providing a reduction in the jittering, has not yet provided satisfactory results.

It is an object of the present invention to provide a method and system for further improving the accuracy of strikes attainable with unguided projectiles, particularly by compensating for inaccuracies that result from barrel jittering or jittering during the projectile firing.

Other objects and advantages of the invention will become apparent as the description proceeds.

SUMMARY OF THE INVENTION

The present invention provides a method for adjusting the flight path of an unguided projectile, comprising:

a) Measuring the magnitude and direction of the jittering of a projectile launch tube, at an ejection time of a projectile from said launch tube;

b) Measuring a velocity deviation of said projectile from a nominal velocity;

c) Measuring an angular deviation of the sight of said launch tube, being equal to the angular deviation between a line coinciding with the direction of gravity and a line passing through the center of the launch tube and the center of the sight;

d) Determining a compensating impulse vector to be applied to said projectile during an initial flight path thereof based on the magnitude and direction of said jittering, velocity deviation and angular deviation; and e) Applying said compensating impulse vector to said projectile by activating a flight correction unit, the thrust developed by said flight correction unit suitable for adjusting the flight path of said projectile by a magnitude and direction substantially equal to that of said compensating impulse vector.

Preferably, said projectile impacts a desired target by continuing on a corrected flight path, following a one-time non-continuous activation of said flight correction unit within a period of approximately 0.2 seconds following said ejection time.

Preferably, the flight correction unit comprises a plurality of pyrotechnic thrusters provided with said projectile.

The present invention is also directed to a system for adjusting the flight path of an unguided projectile, comprising:

a) A projectile provided with a flight correction unit suitable for adjusting the flight path of said projectile;

b) Launching means for said projectile;

c) Means for measuring, at an ejection time of a projectile from said launching means, the magnitude and direction of jittering of said launching means, of velocity deviation of said projectile from a nominal velocity, and of an angular deviation of the sight of said launching means between a line coinciding with the direction of gravity and a line passing through the center of said launch means and the center of said sight;

d) Means for processing data acquired from said measuring means and for generating from said processed data a compensating impulse vector;

e) Communication means between said launching means and said projectile, said communication means adapted to transmit a signal to said projectile representative of said generated compensating impulse vector; and f) Means for determining an activation time of said flight correction unit, such that the thrust developed by said flight correction unit is suitable for adjusting the flight path of said projectile by a magnitude and direction substantially equal to that of said compensating impulse vector.

In a preferred embodiment of the invention, the flight correction unit comprises a plurality of pyrotechnic thrusters, each of said thrusters being mounted at a different angular disposition with respect to the longitudinal axis of the projectile such that the axis of each of said thrusters crosses the longitudinal axis of the projectile.

The means for determining the activation time of said thrusters is a device for measuring the angular displacement of the projectile about its longitudinal axis from said ejection time to a predetermined flight path correction time.

Preferably, said device comprises:

a) a rotatable disc having a sufficiently high moment of inertia, such that it is essentially angularly stationary while the projectile rotates about its longitudinal axis during its flight, said disc being normally separated from an abutment surface connected to the projectile body;

b) opaque and transmissive sections formed in said disc; and c) a light detector connected to said projectile body for emitting and detecting light passing through said opaque and transmissive sections, said disc being pressed against said abutment surface during acceleration of the projectile within a launch tube and being separated therefrom following cessation of said acceleration at said ejection time, said projectile body and said light detector connected thereto rotating about the longitudinal axis of the projectile at a significantly faster rate than said disc, detected light passing through a transmissive section being indicative of an incremental angular displacement of said projectile body.

The system preferably further comprises means for preventing rotation of the projectile within a launching tube, prior to the ejection time.

The present invention is also directed to a launcher system, comprising:

a) A launch tube;

b) Means for launching a projectile from said launch tube in a ballistic trajectory;

c) Means for measuring, at an ejection time of said projectile from said launch tube, the magnitude and direction of jittering of said launch tube, of velocity deviation of said projectile from a nominal velocity, and of an angular deviation of the sight of said launch tube between a line coinciding with the direction of gravity and a line passing through the center of said launch tube and the center of said sight;

d) Means for processing data acquired from said measuring means and for generating from said processed data a compensating impulse vector; and e) Communication means between said launcher processing means and a projectile system, said launcher communication means adapted to transmit a signal to said projectile representative of said generated compensating impulse vector, thrust developed by a flight correction unit carried by said projectile in flight being suitable for adjusting the flight path of said projectile by a magnitude and direction substantially equal to that of said compensating impulse vector.

The present invention is also directed to an unguided projectile system, comprising:

a) A projectile suitable for being launched in a ballistic trajectory;

b) Communication means for receiving from a launcher system a signal representative of a compensating impulse vector which compensates for, at the ejection time of a projectile from a launch tube, the jittering of said launch tube, a velocity deviation of said projectile from a nominal velocity, and an angular deviation of the sight of said launch tube between a line coinciding with the direction of gravity and a line passing through the center of said launch tube and the center of said sight;

c) A device for measuring the angular displacement of the projectile about its longitudinal axis from said ejection time to a predetermined flight path correction time;

d) Two or more pyrotechnic thrusters, each of said thrusters being mounted at a different angular disposition with respect to the longitudinal axis of the projectile such that the axis of each of said thrusters crosses the longitudinal axis of the projectile; and e) Two of said thrusters capable of being activated at said predetermined flight path correction time, such that the thrust developed thereby is suitable for adjusting the flight path of said projectile by a magnitude and direction substantially equal to that of said compensating impulse vector.

The projectile system further comprises a processing means for receiving said compensating impulse vector from said communication means and for synchronizing ignition of two of said thrusters at a predetermined flight path correction time, the adjusted flight path thereby essentially coinciding with a nominal flight path.

The projectile processing means is further adapted to generate an adjusted impulse vector, said adjusted impulse vector being based on said compensating impulse vector and on an incremental impulse vector which compensates for the angular displacement of the projectile measured by said device, two of said thrusters capable of being activated at said predetermined flight path correction time, such that the thrust developed thereby is suitable for adjusting the flight path of said projectile by a magnitude and direction substantially equal to that of said compensating impulse vector.

The projectile is preferably formed with elements that radially protrude from the projectile fuselage, said elements being insertable within complementary grooves formed within said launch tube, during loading of the projectile within the launcher, and being adapted for preventing rotation of the projectile within said launch tube, prior to the ejection time.

DETAILED DESCRIPTION OF PREFERRED EMBODIMENTS

The present invention relates to a method and system for adjusting the flight path of an unguided projectile, immediately after launching, in order to compensate for inaccuracies that result from barrel recoil or jittering during the projectile firing. It will be understood that the term "jittering" throughout the specification also refers to recoil.

Figure 1:
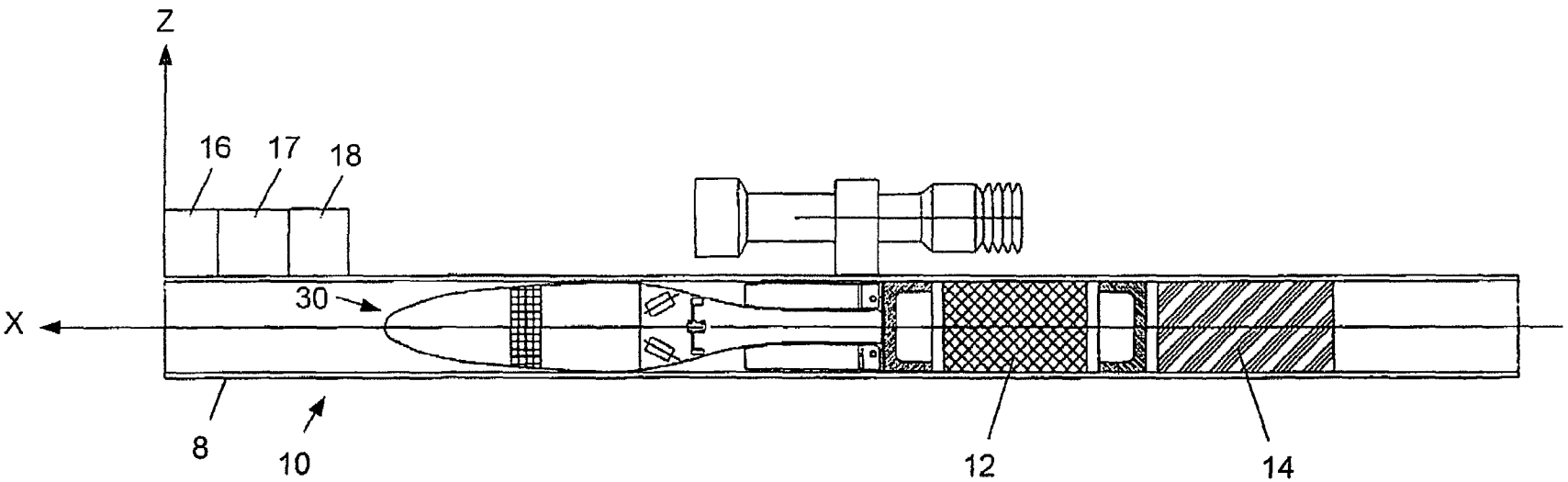
FIG. 1 is a schematic drawing of a side cross sectional view of a launch tube prior to launching, in accordance with the present invention.

FIG. 1 schematically illustrates an exemplary projectile launcher, generally designated by numeral 10, in which a projectile, generally designated by numeral 30, is loaded. Launcher 10 may be fixed onto the barrel of a rifle, may be an independent unit, may be portable such as being a shoulder-carried launcher, or may be deployed in several types of naval or aircraft weaponry.

The illustrated projectile launcher 10, according to one embodiment of the invention, is configured as a Davis gun for obtaining a reduced jittering, with a solid propellant 12 and compensating mass 14 being loaded in launch tube 8, rearward to projectile 30. However, the launcher 10 does not necessarily have to be of this type and can be of any unguided projectile launcher known in the art. During firing, projectile 30 is accelerated forward at a tremendously high rate, which may be as much as 10,000 g for an aircraft-launched missile, and propellant 12 is converted into a gaseous state, causing compensating mass 14 to be ejected rearward through the launch tube, thereby reducing the jittering of launcher 10.

Although greatly reduced in the Davis type launcher, the jittering is nevertheless noticeable and causes a deviation in the flight path from a desired target.

Figure 2:
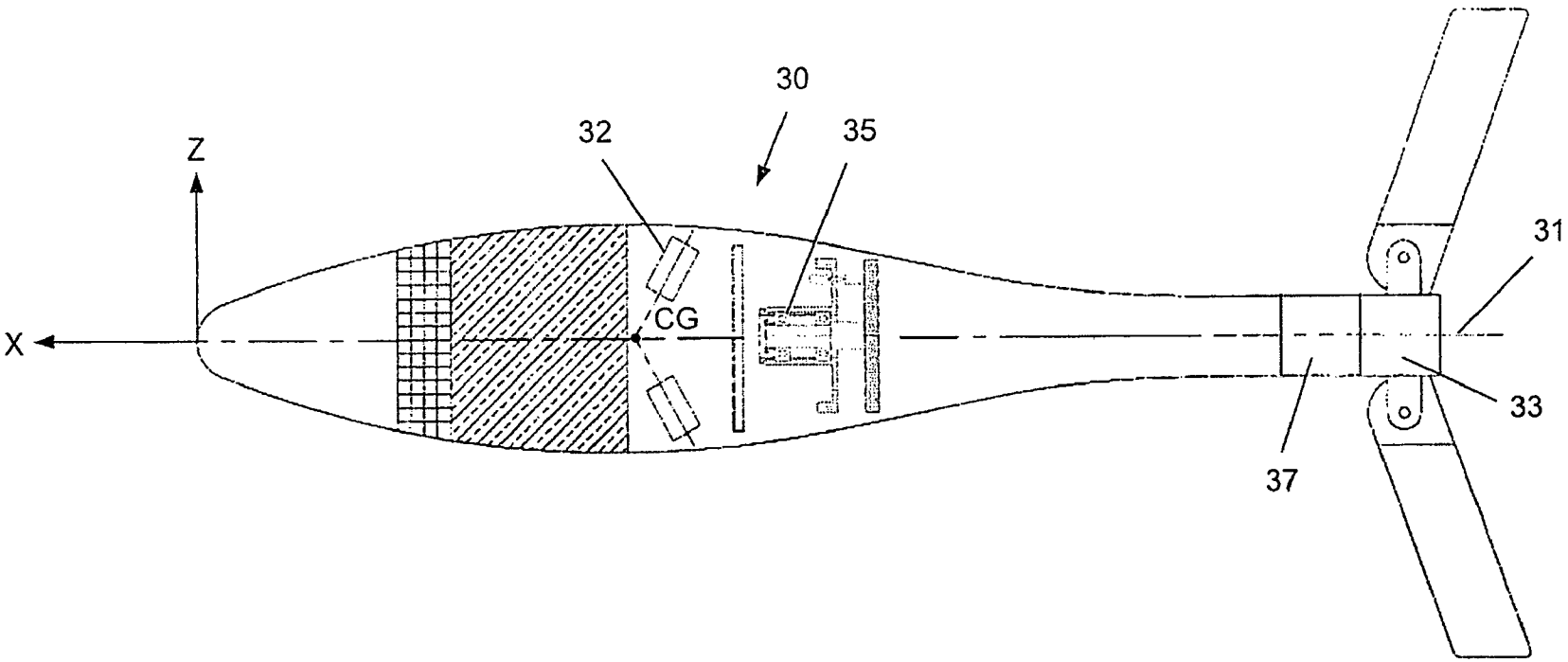
FIG. 2 is a schematic drawing of a projectile, in accordance with the present invention.
Figure 3:
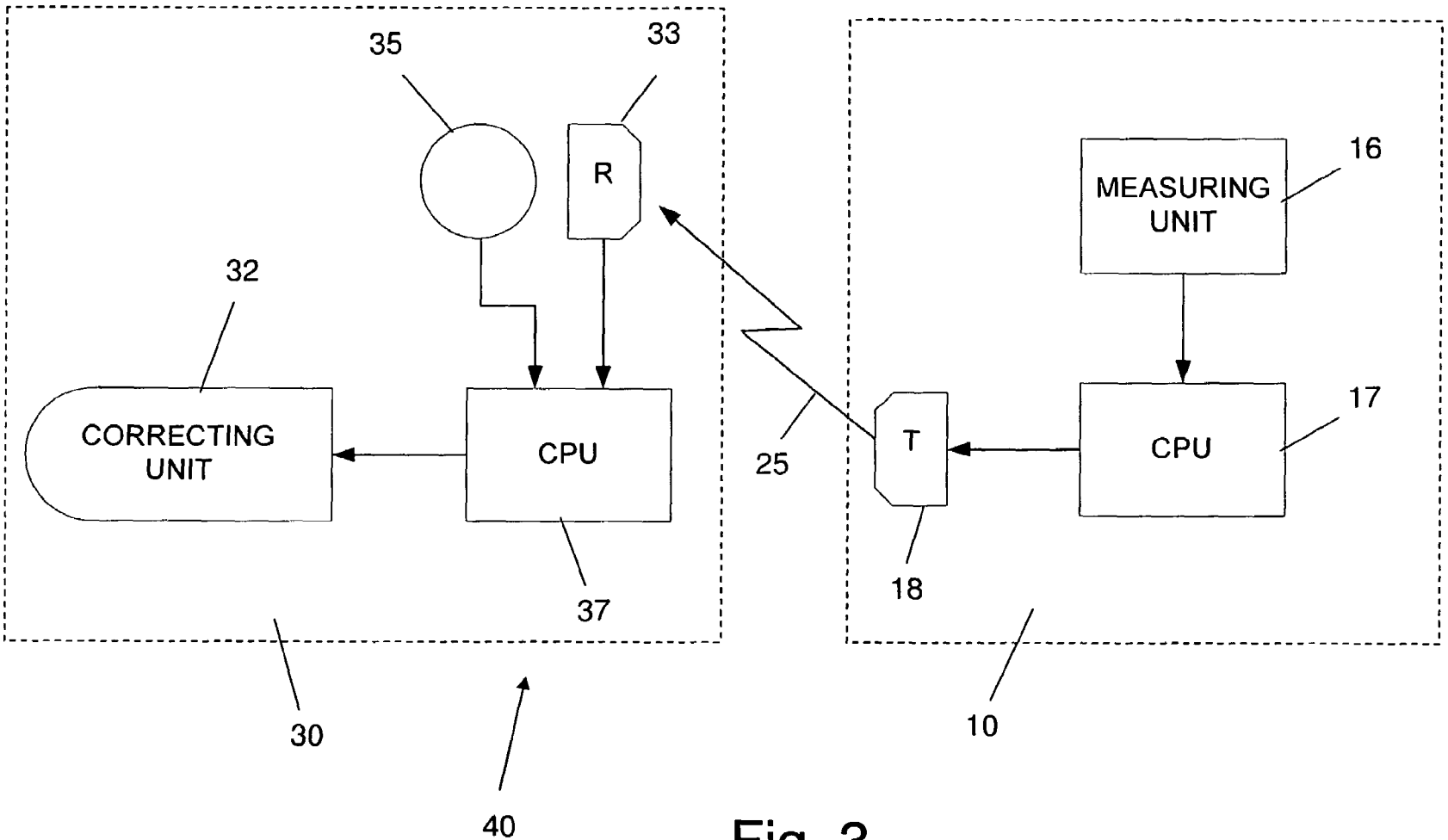
FIG. 3 is a block diagram of the system of the present invention.

FIG. 3 describes a block diagram of system 40 of the invention. With reference to FIGS. 1-3, the system of the present invention comprises the following components, according to a preferred embodiment:

At the Launcher:

- Measuring unit 16 for measuring at launching, parameters relating to the deviation of the flight path jittering from the nominal direction;
- Ground processing unit 17 for (a) determining a compensating impulse vector, which when applied to the projectile shortly after launching, is capable of returning the projectile to the nominal flight path; and (b) for generating signal 25 representative of said compensating impulse vector; and
- Transmitter 18 for transmitting signal 25 to the projectile shortly after launching;

At the Projectile:

- Receiver 33 for receiving signal 25;
- Angular rotation sensor 35 for determining the angular orientation of projectile 30 about longitudinal axis 31 thereof while in flight;
- Projectile processing unit 37 for adjusting the received signal 25, taking into account the difference in angular rotation of the projectile;
- Flight correcting unit 32 for receiving said adjusted signal and generating an impulse within the projectile in order to compensate its flight direction for the launch tube jittering deviation. As will be further described hereinafter, according to one embodiment of the invention, the correcting unit comprises a plurality (two or more) of pyrotechnic thrusters which are ignited at a predetermined time, in order to provide the correcting thrust.

Figure 4C:
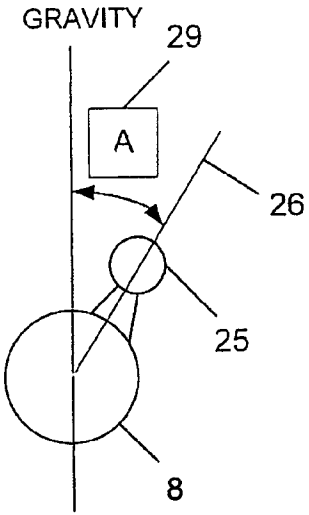
FIGS. 4A-C are schematic diagrams of the measuring unit of the present invention.
Figure 4A:
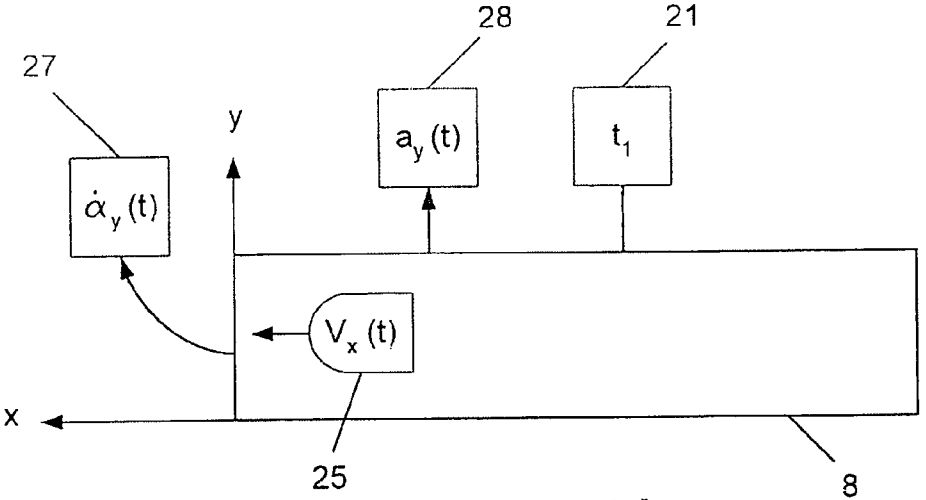
Figure 4B:
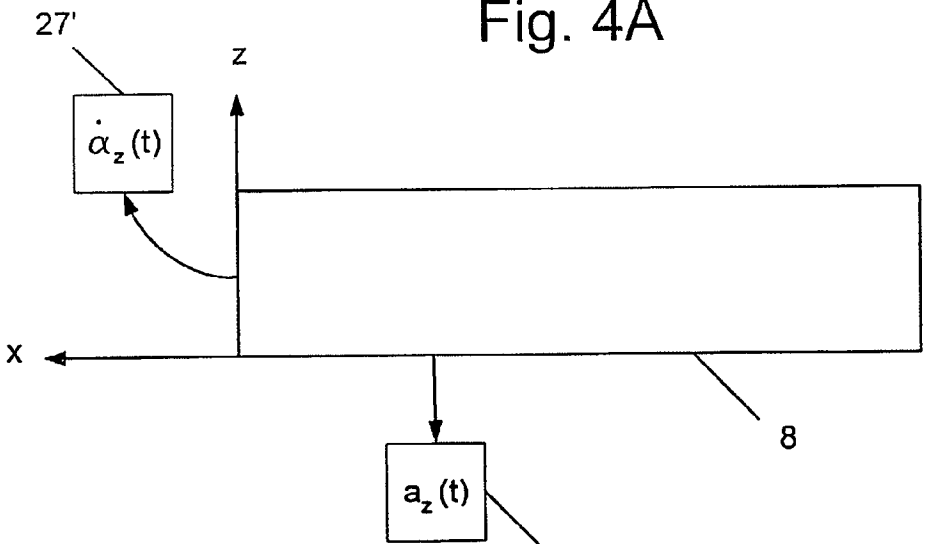

With reference to FIGS. 4A-C, measuring unit 16 comprises the following sensors, which are mounted on launcher 10:

1. sensor 21, e.g. an optical or magnetic sensor, for determining the time $t_1$ of projectile ejection from launch tube 8;
2. sensors 27 and 27' for measuring the angular velocity $\omega_y(t)$ and $\omega_z(t)$ along the x-y and x-z planes, respectively, of the launch tube tip at ejection time $t_1$ (hereinafter, the subscripts y and z denote two axes perpendicular to the instantaneous disposition of the longitudinal axis x of the projectile, with the y-axis and z-axis representative of the sideways and upward/downward deviations, respectively, of the actual flight path relative to the nominal flight path);
3. sensors 28 and 28' for measuring the acceleration $\alpha_y(t)$ and $\alpha_z(t)$ of the launch tube tip along axes y and z, respectively, at ejection time $t_1$;
4. velocity sensor 25, e.g. an optical or magnetic sensor, of the projectile velocity $v_x(t)$ along the x-axis at ejection time $t_1$; and
5. sight angle sensor 29 which senses the direction of gravity and operating analogously to a level, for determining the angular deviation A of launcher sight 25, between a vertical line coinciding with the direction of gravity and a line 26 passing through the center of said launch tube and the center of said sight, caused at the firing of the projectile.

Prior to firing, parameters of a nominal flight path including mass of the projectile, orientation of the launch tube relative to a fixed coordinate system, nominal launch tube attitude relative to a horizontal plane, and projectile velocity at ejection time are input to ground processing unit 17. The nominal flight path parameters are used by ground processing unit 17 for determining flight path deviation and for generating a compensating impulse vector to be applied to the projectile.

Following the firing of the projectile, sensor 21 senses that the projectile has been ejected from the launch tube and accordingly provides data to ground processing unit 17, which is indicative of the projectile ejection. Upon receiving said data, ground processing unit 17 establishes ejection time $t_1$. At ejection time $t_1$, measuring unit 16 senses three deviation values: angular sight deviation A, launch tube attitude deviation $\Delta\alpha$, which is a reflection of the magnitude of the launch tube jittering, and projectile velocity deviation $\Delta V_x$, all of which will be described hereinafter with respect to FIG. 6. The system of the invention is adapted to generate a compensating impulse vector, which compensates for each deviation so that the projectile may return to a nominal flight path.

At time $t_1$, sight angle sensor 29 determines the angular deviation A of launcher sight 25. Ground processing unit 17 then reduces the angular deviation A into components along the y and z axes, and first deviation value 42 (FIG. 6) is therefore determined.

Figure 5:
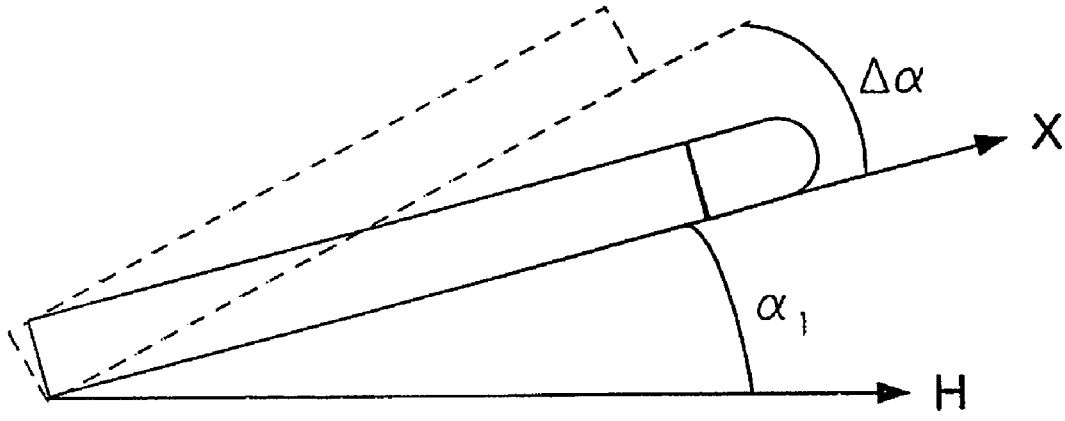
FIG. 5 is a schematic diagram of a launch tube, illustrating an adjustment in a launch tube attitude that is required to compensate for a sensed deviation at the time of projectile ejection.

The launch tube jitters at ejection time $t_1$. Sensors 27 and 27' measure the angular velocity along the x-y and x-z planes, respectively, of the launch tube tip and sensors 28 and 28' measure the acceleration of the launch tube tip along axes y and z, respectively, at time $t_1$. Ground processing unit 17 integrates the sensed values of the acceleration and angular velocity transmitted thereto by the corresponding sensors at ejection time $t_1$ and determines thereby the actual attitude $\alpha_1$ of the launch tube relative to a horizontal plane H, which is schematically illustrated in FIG. 5, and the velocity of the launch tube tip at time $t_1$. The actual attitude is compared with the nominal attitude and second deviation value 43 (FIG. 6) equal to launch tube attitude deviation $\Delta\alpha$, along each of the y and z axes, is determined.

Ground processing unit 17 also determines third deviation value 44 (FIG. 6) concerning projectile velocity $v_1$ along the x axis at ejection time $t_1$, and compares this value with the nominal velocity. The ground processing unit determines a vector which compensates for the projectile velocity deviation in the x axis, between $v_1$ and the nominal velocity ($\Delta V_x$), and reduces this compensating vector into components in the y and z axes.

Figure 6:
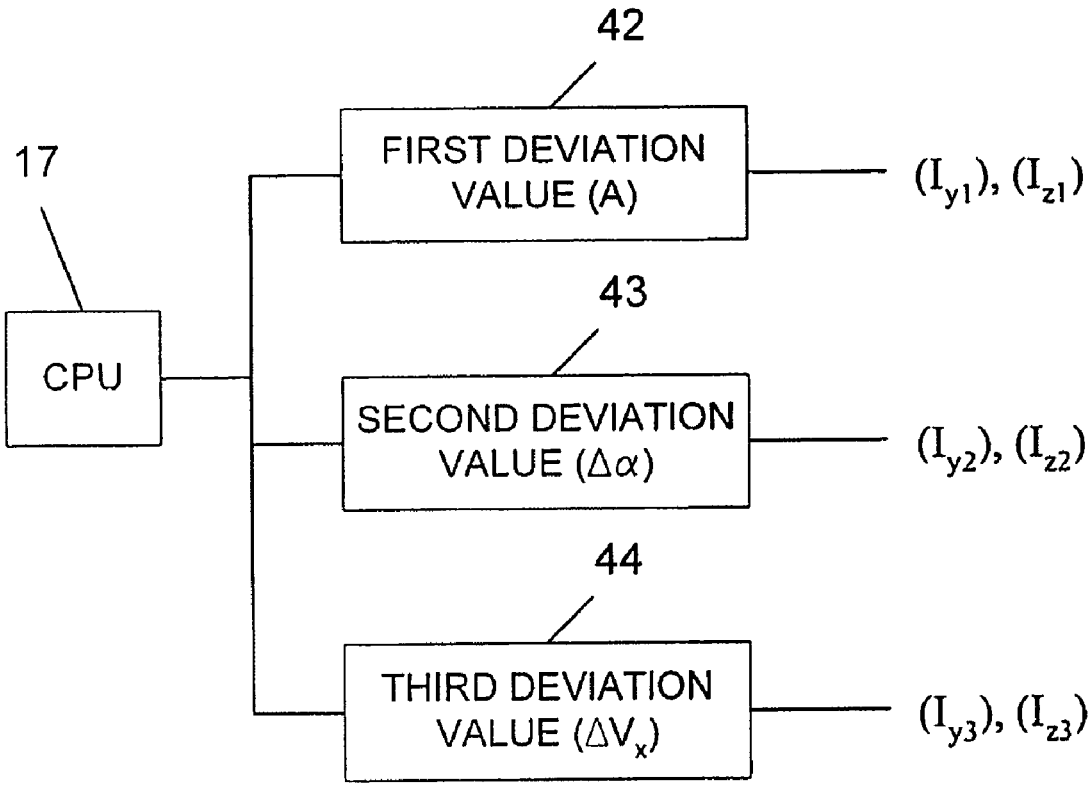
FIG. 6 is a block diagram representing the method of generating a resultant impulse vector from sensed deviation values.

As shown in FIG. 6, processing unit 17 determines an impulse value, which is equal to the product of the mass of the projectile and a difference in velocity, for correcting each of the corresponding deviation values 42, 43 and 44, so that the projectile may return to the nominal flight path and finally strike the intended target. Processing unit 17 generates a pair of impulse components, one on each of the y and z axes, for each of the deviation values, e.g. $I_{y2}$ and $I_{z2}$. Each pair of impulse components is generated in such a way that if no other deviation values resulted, the application of said pair of impulse components onto the center of gravity (CG) of the projectile (FIG. 2) would cause the projectile to return to its nominal flight path. For example, the velocity difference associated with impulse component $I_{y2}$ is based on the equation $\Delta V_y=(\dot{y}+V\alpha)$, namely the sum of the instantaneous velocity along the y axis of the launch tube, and the product of the instantaneous velocity of the projectile along the y axis and the instantaneous attitude of the launch tube $\alpha$, which is actually an approximation of sin $\alpha$, all of the above measured at time $t_1$. Ground processing unit 17 then combines all of the impulse components along the y axis to produce combined impulse component $I_y$ and combines all of the impulse components along the z axis to produce combined impulse component $I_z$. A weighted impulse vector $I_w$ is then generated from combined impulse components $I_y$ and $I_z$. Ground processing unit 17 then generates a signal 25 representative of said weighted impulse vector, and transmits this signal via transmitter 18 (FIG. 3) to the projectile in flight.

As shown in FIG. 3, signal 25 is transmitted to receiver 33 carried by the projectile. According to the present invention, this signal is transmitted very shortly after launching, in the range of approximately 0.2 seconds after firing, in order to minimize inaccuracies. Signal 25 may be transmitted by wireless means, by a fiber optic cable connecting transmitter 18 and receiver 33, which is severed shortly after ejection of the projectile from the launch tube, or any other means of communication well known to those skilled in the art.

Projectile processing unit 37 receives signal 25 and commands flight correcting unit 32 to apply the compensating impulse vector at the correct instant, so that the actual flight path of the projectile may be corrected to coincide with the nominal flight path and so that the projectile warhead may accurately strike a selected target. Flight path correction in accordance with the present invention is dependent upon accurate application of the compensating impulse vector. Since the projectile rotates about its longitudinal axis while in flight in order to reduce drifting, flight correcting unit 32 rotates as well. If the angular displacement of the flight correcting unit following projectile ejection time $t_1$ were unknown, the compensating impulse vector would be liable to be applied at an incorrect direction, and the flight path would not be corrected. Projectile processing unit 37 receives data from angular rotation sensor 35 concerning the angular displacement of the projectile following time $t_1$, and accordingly adjusts the impulse vector that is to be applied to the projectile. The adjusted impulse vector that is to be applied to the projectile is weighted impulse vector $I_w$ combined with an incremental impulse vector that takes into account the difference in angular position of the flight correcting unit between time $t_1$ and the time at which flight correction is effected, hereinafter referred to as time $t_2$.

Figure 7:
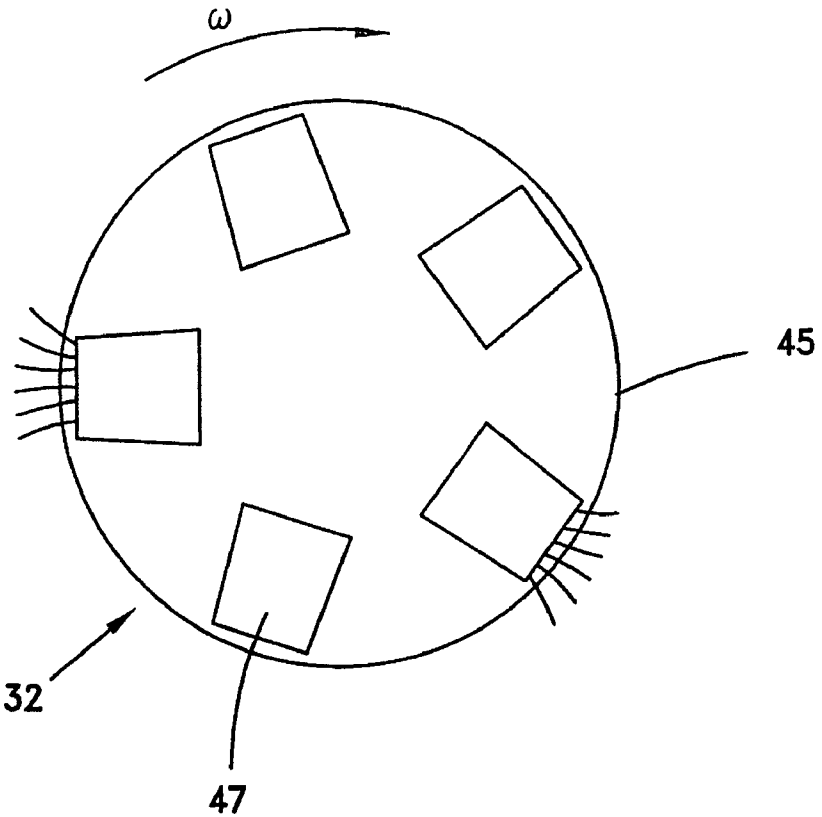
FIG. 7 is a schematic diagram of a portion of a projectile body, illustrating the configuration of the flight correction unit.

FIG. 7 illustrates a preferred embodiment of flight correcting unit 32. Flight correcting unit 32 is mounted on a cylindrical portion 45 of the projectile body, which is preferably, but not necessarily at the rear of the projectile. Flight correcting unit 32 comprises a plurality of pyrotechnic thrusters 47, e.g. miniature jet engines, each of which is mounted to the portion 45 of the projectile body, at a different orientation with respect to longitudinal axis 31 of the projectile (FIG. 2) such that the axis of each of said thrusters crosses longitudinal axis 31 of the projectile. Five pyrotechnic thrusters 47 are shown, but it will be appreciated that any other number of thrusters from two to five which is suitable for controlling the magnitude and direction of the adjusted impulse vector may be similarly employed. The projectile rotates about its longitudinal axis while in flight at a typical angular rate $\omega$ of approximately 5-10 Hz, and this rotational rate may be utilized to fire a thruster at a precise angle which is predetermined by processing unit 37. Therefore thrusters 47 are not adapted to accelerate the projectile any more than the acceleration imparted by the launcher, but rather are used to change the orientation of the projectile, so that it may accurately impact a selected target. By one-time firing of a selected number of thrusters, and at the appropriate orientation, the magnitude and direction of the adjusted impulse vector are controllable.

Figure 8:
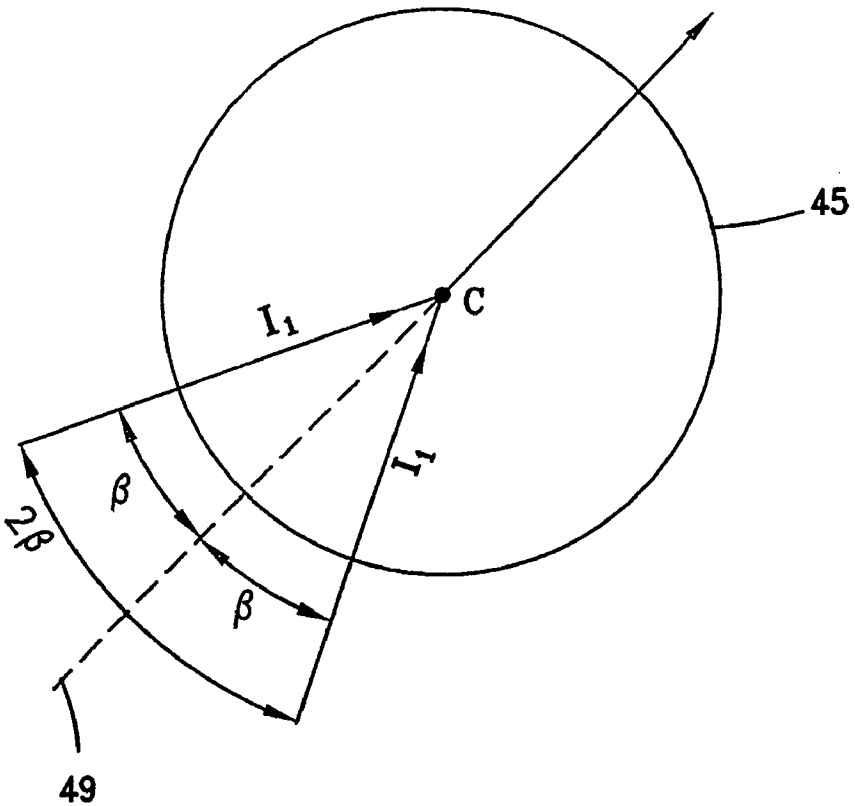
FIG. 8 is a schematic diagram of the generation of a resultant impulse vector from two impulse components.

FIG. 8 schematically depicts the generation of an adjusted impulse vector I. Two thrusters separated by an angular distance of $2\beta$ were fired. Since each thruster is identical, the impulse vector generated by each thruster has an equal magnitude of $I_1$ and is directed inward to center C of portion 45 of the projectile body. The resultant impulse vector I is equal to $2\ I_1 \sin\beta$ and is collinear with the centerline 49 between the two thrusters, directed outwardly from center C. It will be appreciated that any other number of thrusters may be fired, and the resultant impulse vector will be similarly determined from the total number of individual components.

Figure 9:
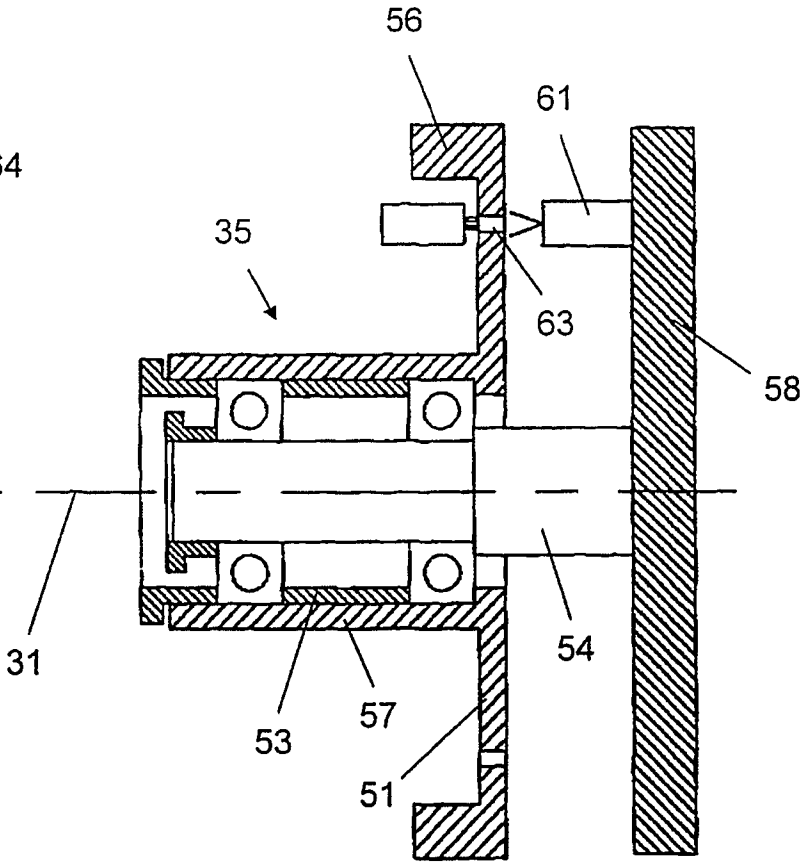
FIG. 9 is a side cross sectional view of a sensor for measuring the angular rotation of a projectile in flight, in accordance with the present invention.
Figure 10:
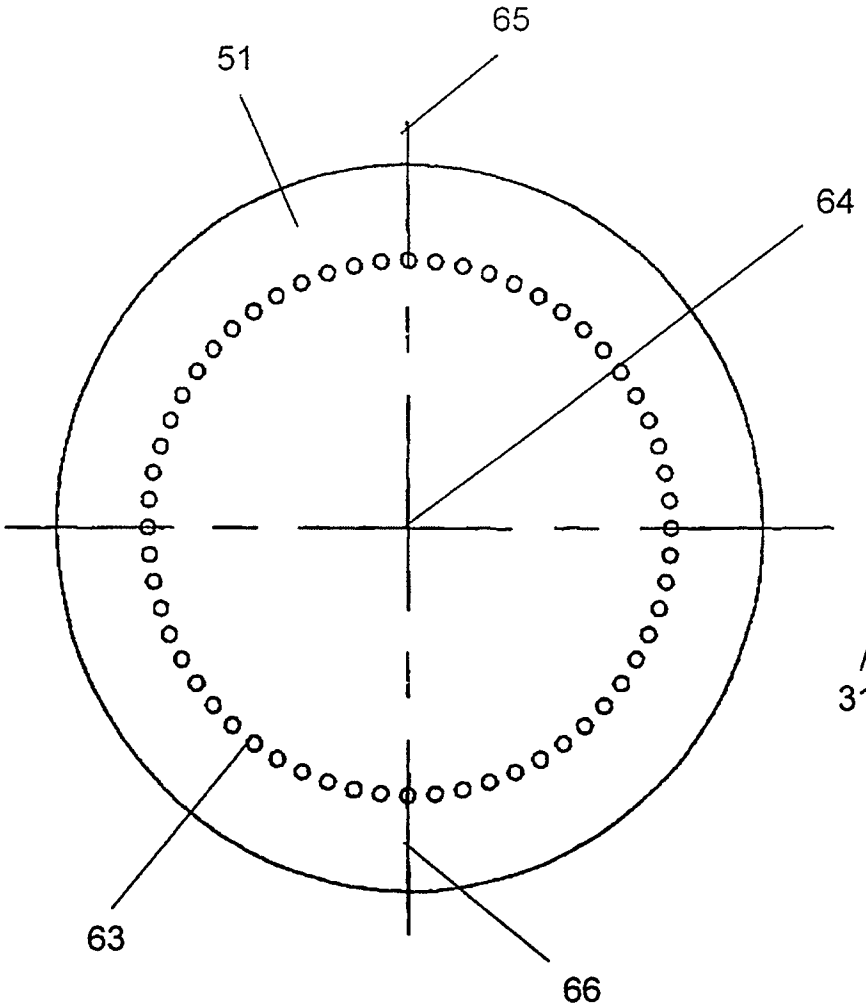
FIG. 10 is a front view of the angular rotation sensor of FIG. 9.

As described hereinabove, accurate measurement of the angular position of each thruster is needed for compensation of launch tube jittering. FIGS. 9 and 10 illustrate angular rotation sensor 35, which is used to measure the angular displacement of the projectile about its longitudinal axis. Angular rotation sensor 35 comprises disc 51 provided with collar 57, which is coaxial with longitudinal axis 31 of the projectile. Collar 57 facilitates the mounting of disc 51 on bearing block 53, which is fixedly attached to fuselage 58 of the projectile by means of adaptor 54, so that disc 51 is rotatable about bearing block 53. The rim of disc 51 is provided with a weighted portion 56, which is adapted to reduce the angular velocity of disc 51. Weighted portion 56 is normally separated from an abutment surface (not shown), which is a part of the fuselage. Disc 51 is formed with a plurality of apertures 63, which are formed at a uniform radial distance from disc center 64 and are at a fixed angular distance with respect to centerline 65 one from the other. Light detector 61, e.g. an encoder, is mounted onto fuselage 58 and emits a beam of light that is directed to one of the apertures.

Figure 11:
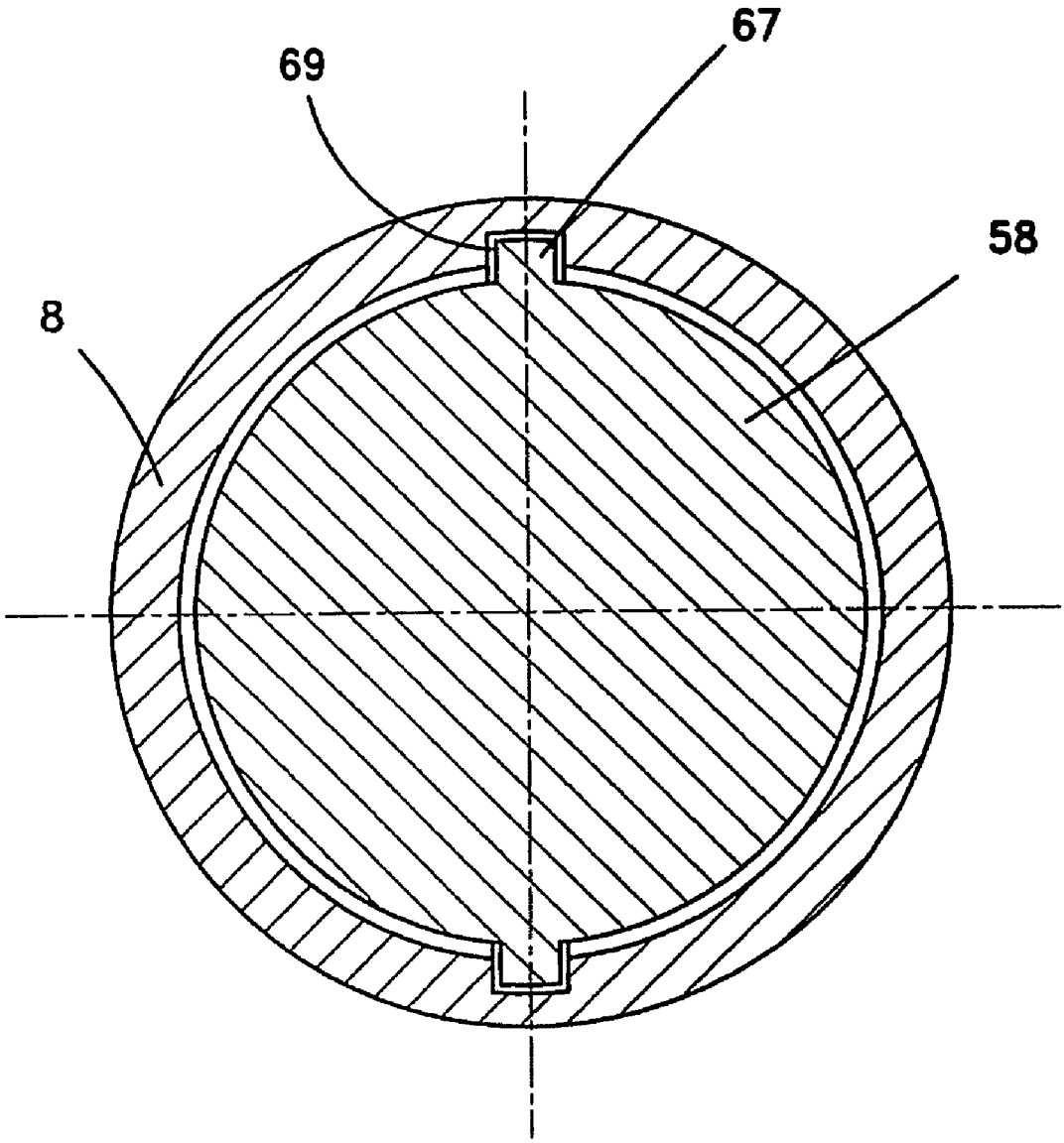
FIG. 11 is a cross sectional view of a launch tube in which a projectile is loaded, showing means for preventing rotation of the projectile within the launch tube.

During launching, the projectile is accelerated within the launch tube and is prevented from rotating, so that the angular orientation of a datum provided with disc 51 may be determined at ejection time $t_1$. As shown in FIG. 11, one or more protrusions 67 radially protrude from fuselage 58 of the projectile. These protrusions 67 are insertable, during loading of the projectile, in complementary grooves 69 formed in the tubular inner wall of launch tube 8. During forward propulsion of the projectile, protrusions 67 slide within grooves 69, and the projectile is therefore prevented from rotating within launch tube 8.

Referring back to FIGS. 9 and 10, disc 51 is pressed to the abutment surface as a result of the acceleration of the projectile during launching and is therefore unable to rotate. Upon ejection of the projectile from the launch tube at time $t_1$, the projectile ceases to accelerate and is propelled along a flight path under the influence of momentum, as a result of its initial velocity $V_1$ at time $t_1$, and of gravity. Since disc 51 ceases to be accelerated after being ejected from the launch tube, it is no longer pressed against the abutment surface and is therefore free to rotate. While the projectile begins to rotate about its longitudinal axis after ejection, due to the configuration of the projectile and to the airstreams that pass therearound, the angular rotation of disc 51 is significantly limited by weighted portion 56, e.g. is on the order of approximately 1 revolution per hour. Thus disc 51 may be considered stationary relative to fuselage 58. Since light detector 61 is connected to fuselage 58, in-flight rotation of the projectile about its longitudinal axis results in rotation of the light detector about the longitudinal axis of the projectile. Light emitted from light detector 61 onto apertures 63 of the relatively stationary disc 51 is therefore indicative of the degree of angular rotation of the disc. Light detector 61 transmits the data concerning the angular difference of datum 66 from time $t_1$, at which the projectile begins to rotate relative to the disc, to predetermined flight path correction time $t_2$ to processing unit 37 (FIG. 3), whereupon the signal received from transmitter 18 is adjusted and the adjusted impulse vector is applied to the projectile center of gravity by means of flight correcting unit 32, as described hereinabove.

Optionally, projectile processing unit 37 may also adjust a compensating impulse vector by taking into account the time difference between ejection time $t_1$ and the flight path correction time $t_2$. Signal 25 is representative of the compensating impulse vector, which is generated by ground processing unit 17 (FIG. 3), in order to correct the projectile position at time $t_1$ due to the presence of deviation values 42, 43 and 44 (FIG. 6). However, the projectile position invariably changes from time $t_1$ to time $t_2$, a time of approximately 0.05 sec, and therefore the resultant impulse vector I (FIG. 8) generated at flight path correction time $t_2$ may result in an inaccurate strike. A clock (not shown), which is in communication with projectile processing unit 37 (FIG. 3), measures the time difference between $t_1$ and $t_2$. Projectile processing unit 37 (FIG. 3) accordingly adjusts the required impulse vector based on the difference in the projectile position between $t_1$ and $t_2$.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

What is claimed is:

1. A method for adjusting the flight path of a projectile, comprising:

a) Measuring the magnitude and direction of the uttering of a projectile launch tube, at an ejection time of a projectile from said launch tube;

b) Measuring a velocity deviation of said projectile from a nominal velocity;

c) Measuring an angular deviation of the sight of said launch tube, being equal to the angular deviation between a line coinciding with the direction of gravity and a line passing through the center of the launch tube and the center of the sight;

d) Determining a compensating impulse vector to be applied to said projectile during an initial flight path thereof based on the magnitude and direction of said uttering, velocity deviation and angular deflection; and e) Applying said compensating impulse vector to said projectile by activating a flight correction unit, the thrust developed by said flight correction unit adjusts the flight path of said projectile by a magnitude and direction substantially equal to that of said compensating impulse vector.

2. The method according to claim 1, wherein said projectile impacts a desired target by continuing on a corrected flight path, following a one-time non-continuous activation of said flight correction unit.

3. The method according to claim 2, wherein activation of the flight correction unit is within a period of approximately 0.2 seconds following said ejection time.

4. The method according to claim 1, wherein the flight correction unit comprises a plurality of pyrotechnic thrusters provided with said projectile.

5. A system for adjusting the flight path of a projectile, comprising:

a) A projectile provided with a flight correction unit for adjusting the flight path of said projectile;

b) Launching means for said projectile;

c) Means for measuring, at an ejection time of a projectile from said launching means, the magnitude and direction of jittering of said launching means, of velocity deviation of said projectile from a nominal velocity, and of an angular deflection of a line passing through the center of said launching means and the center of the sight of said launching means from a line coinciding with the direction of gravity;

d) Means for processing data acquired from said measuring means and for generating from said processed data a compensating impulse vector;

e) Communication means between said launching means and said projectile for transmitting a signal to said projectile representative of said generated compensating impulse vector; and f) Means for determining an activation time of said flight correction unit, such that the thrust developed by said flight correction unit adjusts the flight path of said projectile by a magnitude and direction substantially equal to that of said compensating impulse vector.

6. The system according to claim 5, wherein the flight correction unit comprises a plurality of pyrotechnic thrusters, each of said thrusters being mounted at a different angular disposition with respect to the longitudinal axis of the projectile such that the axis of each of said thrusters crosses the longitudinal axis of the projectile.

7. The system according to claim 6, wherein the means for determining the activation time of said thrusters is a device for measuring the angular displacement of the projectile about its longitudinal axis from said ejection time to a predetermined flight path correction time.

8. The system according to claim 7, wherein the device comprises:

a) a rotatable disc provided with an intermediate portion and a weighted portion on the rim thereof having a thickness greater than that of said intermediate portion, said disc normally separated from an abutment surface connected to the projectile body and said weighted portion adapted for limiting the angular velocity of said disc;

b) opaque and transmissive sections formed in said intermediate portion; and c) a light detector connected to said projectile body for emitting and detecting light passing through said opaque and transmissive sections, said disc being pressed against said abutment surface during acceleration of the projectile within a launch tube and being separated therefrom following cessation of said acceleration at said ejection time, said projectile body and said light detector connected thereto rotating about the longitudinal axis of the projectile at a faster rate than said disc, detected light passing through a transmissive section being indicative of an incremental angular displacement of said projectile body.

9. The system according to claim 6, further comprising means for preventing rotation of the projectile within a launching tube, prior to the ejection time.

10. A launcher system, comprising:

a) A launch tube;

b) Means for launching a projectile from said launch tube in a ballistic trajectory;

c) Means for measuring, at an ejection time of said projectile from said launch tube, the magnitude and direction of jittering of said launch tube, of velocity deviation of said projectile from a nominal velocity, and of an angular deviation of the sight of said launch tube between a line coinciding with the direction of gravity and a line passing through the center of said launch tube and the center of said sight;

d) Means for processing data acquired from said measuring means and for generating from said processed data a compensating impulse vector; and e) Communication means between said data processing means and a projectile system for transmitting a signal to said projectile representative of said generated compensating impulse vector, thrust developed by a flight correction unit carried by said projectile in flight adjusting the flight path of said projectile by a magnitude and direction substantially equal to that of said compensating impulse vector.

11. An unguided projectile system, comprising:

a) A projectile for being launched in a ballistic trajectory;

b) Communication means for receiving from a launcher system a signal representative of a compensating impulse vector which compensates for, at the ejection time of a projectile from a launch tube, the uttering of said launch tube, a velocity deviation of said projectile from a nominal velocity, and an angular deviation of the sight of said launch tube between a line coinciding with the direction of gravity and a line passing through the center of said launch tube and the center of said sight;

c) A device for measuring the angular displacement of the projectile about its longitudinal axis from said ejection time to a predetermined flight path correction time; and d) Two or more pyrotechnic thrusters, each of said thrusters being mounted at a different angular disposition with respect to the longitudinal axis of the projectile such that the axis of each of said thrusters crosses the longitudinal axis of the projectile, wherein two of said thrusters are activated at said predetermined flight path correction time, such that the thrust developed thereby adjusts the flight path of said projectile by a magnitude and direction substantially equal to that of said compensating impulse vector.

12. Projectile system according to claim 11, further comprising processing means for receiving said compensating impulse vector from said communication means and for synchronizing ignition of two of said thrusters at a predetermined flight path correction time, the adjusted flight path thereby essentially coinciding with a nominal flight path.

13. Projectile system according to claim 12, wherein an adjusted impulse vector is generated by means of the projectile processing means, said adjusted impulse vector being based on said compensating impulse vector and on an incremental impulse vector which compensates for the angular displacement of the projectile measured by said device, two of said thrusters being activated at said predetermined flight path correction time, such that the thrust developed thereby adjusts the flight path of said projectile by a magnitude and direction substantially equal to that of said compensating impulse vector.

14. Projectile system according to claim 11, wherein the projectile is formed with elements that radially protrude from the projectile fuselage, said elements being inserted within complementary grooves formed within said launch tube during loading of the projectile within the launcher, and being adapted for preventing rotation of the projectile within said launch tube, prior to the ejection time.

* * * * *